United States Patent [19]

Schauer

[11] Patent Number: 4,707,914

[45] Date of Patent: Nov. 24, 1987

[54] METHOD OF CONNECTING TWO ELECTRIC LINES AND CONNECTION POINT PRODUCED THEREBY

[75] Inventor: Friedrich Schauer, Heroldsberg, Fed. Rep. of Germany

[73] Assignee: kabelmetal electro Gesellschaft mit beschränkter Haftung, Hanover, Fed. Rep. of Germany

[21] Appl. No.: 843,893

[22] Filed: Mar. 24, 1986

[30] Foreign Application Priority Data

Mar. 22, 1985 [DE] Fed. Rep. of Germany ..... 3510370

[51] Int. Cl.[4] ..... H01R 43/00

[52] U.S. Cl. ..... 29/872; 29/869

[58] Field of Search ..... 29/868, 869, 872; 264/272.11

[56] References Cited

U.S. PATENT DOCUMENTS 4,249,304 2/1981 Weinmann et al. ..... 29/872

*Primary Examiner*—Timothy V. Eley

*Attorney, Agent, or Firm*—Martin A. Farber

[57] ABSTRACT

A method of electrically connecting a flat-conductor ribbon line (1) to a flexible connecting line (6) having stranded conductors. The wires (8, 9) of the connecting line (6) are of different length, with a difference in length which corresponds to the distance of the flat conductors (2, 3) from each other. The one flat conductor (3) can be bent back until it rests against the insulation of the flat-conductor ribbon line (1). The two lines (1, 6) are connected to each other at a right angle and the line ends are embedded in the protective body (10) which is formed by injection.

7 Claims, 3 Drawing Figures

METHOD OF CONNECTING TWO ELECTRIC LINES AND CONNECTION POINT PRODUCED THEREBY

FIELD AND BACKGROUND OF THE INVENTION

The invention refers to a method of producing an electrically conductive connection between conductors of a flat-conductor ribbon line, in which at least two flat conductors are arranged parallel to and spaced from each other within a common insulation, and conductors of a flexible connection line which comprises at least two wires with stranded conductors surrounded by an insulation.

Line arrangements having flat-conductor ribbon lines, on the one hand, and flexible connecting lines, on the other hand, are required, for instance, in devices in which the line must be able to participate in a turning movement so as to avoid slip rings or other sliding contacts without the current path being interrupted. Such devices comprise, for instance, cable coilers within which a flat-conductor ribbon line is spirally wound so that it can participate without damage in several revolutions of the reel on which a cable is wound or is being wound. Also in the field of steering wheels of automobiles, a flat-conductor ribbon line wound around a steering wheel can be used for the supplying of electricity to devices and control units. One example of this is the electric release of the air feed for an air bag in the event of an automobile accident.

In all cases, a flat conductor ribbon line can be arranged in very space-saving fashion due to its small dimensions. For its further connection to a source of current there is required a flexible connecting line which can be easily laid in any desired length. Due to their required flexibility such connecting lines have wires with stranded conductors which must be connected in electrically conductive manner to the flat conductors of the flat-conductor ribbon line. In this connection a great deal of care must be applied since it may very easily happen that individual wires of the stranded conductors protrude laterally and therefore are not included upon the fastening of the stranded conductors to the flat conductors. Since the flat conductors lie closely alongside of each other due to considerations of space, it can easily happen that such individual wires come into contact with another conductor so that a short circuit occurs. In order definitely to avoid this, very careful inspection of the points of connecting between the conductors has heretofore been necessary. Individual protruding wires must then be subsequently removed.

SUMMARY OF THE INVENTION

It is an object of the invention to provide a method by which flat conductors of a flat-conductor ribbon line and stranded conductors of a flexible connecting line can be so connected to each other in a simple manner that individual protruding wires of the stranded conductors can no longer prove disturbing. The points of connection of the conductors should furthermore be so mechanically stable after their production that no relative movement of the conductors with respect to each other is possible.

According to the invention, this object is solved in that:

first of all, the flat conductors (2, 3) of the flat-conductor ribbon line have their insulation removed;

the wires (8, 9) of the connecting line (6), from which the common jacket (7), if any, has been removed, are then cut to length in such a way that they are of different length, the difference in length corresponding to the center-to-center distance (A) between the flat conductors (2, 3);

the insulation is them removed from the end of the wires (8, 9); exposing stranded conductors (4, 5)

thereupon stranded conductor (4, 5) each is placed perpendicularly against a corresponding flat conductor (2, 3) and connected in electrically conductive manner to it; and thereupon a protective body (10) of insulating material is molded as by spraying material around the points of connection of the two lines (1, 6).

In this method, the wires of the flexible connecting line are cut to different length so that the individual wires of the individual stranded conductors cannot contact each other after removal of the insulation even if they protrude sidewards in uncontrolled manner. This is true also after the attachment of the stranded conductors to the flat conductors since the stranded are brought at a right angle to the flat conductors and connected in this position to the latter. Each stranded conductor is just so long that it reaches the associated flat conductor. Contact between "wrong" conductors is thereby impossible even if individual wires protrude from the stranded conductors. The mutual position of the flat conductors and stranded conductors is fixed by the protective body which is finally formed by injection molding around the line ends so that no relative movement of the conductors with respect to each other is possible any longer. The line ends of the two lines which extend at right angles to each other are also stiffened by the protective body so that the points of connection of the conductors are mechanically protected in all respects and at the same time embedded in a moisture-proof manner.

The assurance against contact between wrong wires can also be increased in the manner that in the case of two-wire lines the one flat conductor, after the fixing of the stranded conductor to be connected to it, is bent back until it comes against the insulation of the flat-conductor ribbon line. In this way the dimensions of the protective body can also be kept relatively small.

BRIEF DESCRIPTION OF THE DRAWINGS

With the above and other objects and advantages in view, the present invention will become more clearly understood in connection with the etailed description of preferred embodiments, when considered with the accompanying drawings, of which.

DETAILED DESCRIPTION OF THE PREFERRED EMBODIMENT

Figure 1:
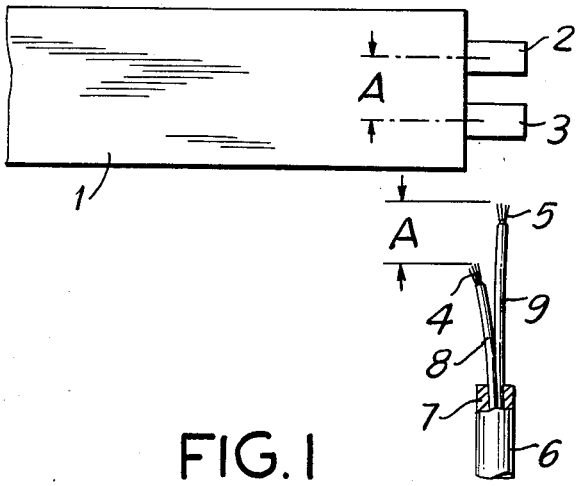
FIG. 1 is a partly cross-sectional view of the bared ends of two electric lines to be connected to each other.

The following description applies, with reference to the drawings, to two-wire lines. The invention is not limited to two-wire lines but can be used also for lines having more than two wires.

In a flat-conductor ribbon line 1, two flat conductors 2 and 3 are arranged parallel to and spaced from each other within a common insulation. Flat-conductor ribbon lines have the advantage that, due to their flatness they take up only a small amount of space. The flat conductors are arranged in mechanically stable fashion within a common insulation which is produced as a rule by lamination without the good, easy bendability of the flat-conductor ribbon line being impaired. Flat-conductor ribbon lines can therefore be bent or rolled and unrolled a very large number of times without danger of damaging the flat conductors.

Stranded conductors 4 and 5 of a flexible connecting line 6—referred to below merely as "line"—are to be connected in electrically conductive manner to the bared flat conductors 2 and 3. The wires 8 and 9 which protrude from the jacket 7 of the line 6 are of different length, the distance apart A of their ends or of the ends of the stranded conductors 4 and 5 corresponding to the center-to-center distance between the flat conductors 2 and 3.

The method of the invention is carried out, for example, in the following manner:

The insulation is first removed from the flat conductors 2 and 3. The jacket is then removed from the two wires 8 and 9 and they are cut to length, the wire 8 being made shorter by the distance A than the wire 9. The insulation is then removed from the two wires 8 and 9 so that the stranded conductors 4 and 5 are exposed. The bared ends of the flat conductors 2 and 3, on the one hand, and of the stranded conductors 4 and 5, on the other hand, are then brought together at a right angle to each other and connected in electrically conductive manner to each other. This can be done, for instance, by welding or soldering.

Figure 2:
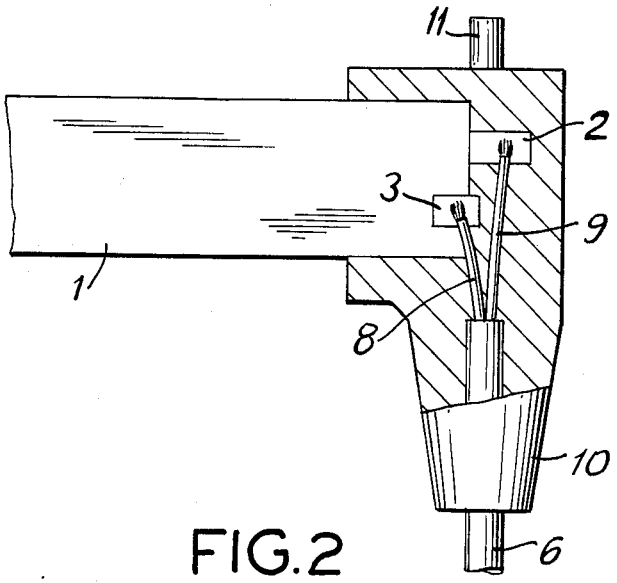
FIG. 2 is a partly cross-sectional view of the finished point of connection between two electric lines.

The two pairs of conductors could be connected simultaneously with each other. Preferably, however, one proceeds in the manner that the stranded conductor 8 is first connected to the flat conductor 3. The flat conductor 3 is then bent back, together with the connected stranded conductor 8, until it comes against the insulation of the flat-conductor ribbon line 1, as can be noted from FIG. 2. The stranded conductor 9 is then connected to the flat conductor 2. The junction point between the two lines 1 and 6 which has thus been formed is then inserted into an injection molding die in which a protective body 10, consisting of insulating material is injected around the juncture point.

By the bending back of the flat conductor 3, the free length of the flat conductor 2 can be kept very short. As a result, the dimensions of the protective body 10 which protrude beyond the flat conductor ribbon line 1 can be kept relatively small.

The protective body 10 preferably consists of a material which becomes relatively hard, such as, for instance, polyamide. In addition to its function of protecting the place of connection, it can at the same time serve as fixed point for the two lines 1 and 6 by fastening it mechanically to the housing of an appliance. If a pin 11 which lies in the extension of the line 6 is also formed on the protective body 10 then the protective body 10 can also be used as rotary member in which the two lines 1 and 6 are fixed. The protective body 10 also surrounds the ends of the two lines 1 and 6 so that, as a whole, a mechanically firm moisture-tight covering of the entire place of connection is obtained with simultaneous stress relief of the connections of the pairs of conductors.

Figure 3:
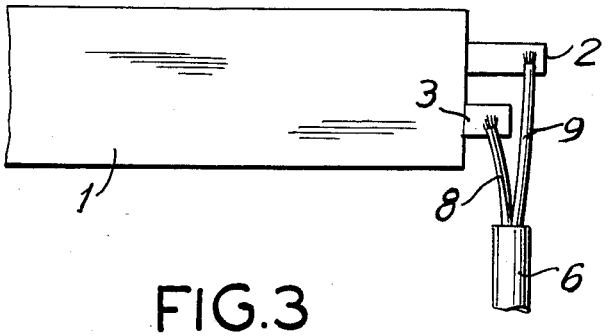
FIG. 3 is a view similar to FIG. 1 but showing an embodiment which is different from FIG. 2.

For increased assurance against undesired contact between wrong wires it is also possible, for instance, to shorten the flat conductor 3, after the insulation has been removed from it, as compared with the flat conductor 2, as shown in FIG. 3. The wire 9 with the stranded conductor 5 can then be brought past the flat conductor 3 without bending the latter rearward.

I claim

1. In a method of producing an electrically conductive connection between conductors of a flat-conductor ribbon line, in which at least two flat conductors are arranged parallel to and spaced apart from each other within a common insulation, and conductors of a flexible connecting line which comprises at least two wires with stranded conductors surrounded by a common insulating jacket, the method comprising the steps of removing the insulation from the flat conductors of the flat-conductor ribbon line to expose end portions of the flat conductors, cutting the wires of the connecting line to different lengths to provide a shorter wire and a longer wire, the difference in length between the two wires being equal to the spacing between corresponding points of said end portions of the flat conductors, removing insulation from the end of each of the wires to expose a stranded conductor in each of the wires, placing each stranded conductor of each wire against and perpendicular to the end portion of a corresponding one of the flat conductors, connecting each stranded conductor in electrically conductive manner to the respective end portion at a point of connection on the respective flat conductor, and then moulding a protective body of insulating material around the points of connection of the two lines.

2. The method according to claim 1 further comprising the step of removing the common jacket from the wires of the connecting line, prior to the cutting step.

3. The method according to claim 1 wherein one of said flat conductors of the ribbon line is closer than the other of said flat conductors to said connecting line, and wherein, in said step of connecting each stranded conductor, the stranded conductor of the shorter wire is first connected in electrically conductive manner to the nearer flat conductor and, thereafter, said nearer flat conductor with the stranded conductor fastened to it, is then bent back against the insulation of the flat-conductor ribbon line, whereupon said step of connecting includes a subsequent step of connecting the other stranded conductor in electrically conductive manner to the further flat conductor.

4. The method according to claim 1 further comprising a cutting of the flat conductors to different lengths after removal of their insulation.

5. A connection between flat conductors of a flat-conductor ribbon line and stranded conductors of a flexible connecting line comprising:

a first and a second flat conductors, a first and a second stranded conductors which are arranged perpendicularly to said flat conductors and are connected in electrically conductive manner at respective points of connection to respective ones of said flat conductors; and wherein said first and second stranded conductors are of different length with a difference in length equal to a spacing between corresponding points of said first and said second flat conductors; and said points of connection lie on end portions of said flat conductors and of said stranded conductors, there being a protective body of injection-molded insulating material surrounding said points of connection.

6. A connection according to claim 5 wherein said first flat conductor, with the stranded conductor fastened to it, is bent back against the insulation of the flat-conductor ribbon line.

7. A connection according to claim 5 further comprising an outwardly projecting pin lying in an extension of the connecting line and being disposed on the protective body.

* * * * *